United States Patent [19]

Marks

[11] Patent Number: 4,793,166

[45] Date of Patent: Dec. 27, 1988

[54] MULTI-USE LOCK CYLINDER

[76] Inventor: George R. Marks, 19, The Hemlocks, Roslyn Estates, N.Y. 11576

[21] Appl. No.: 940,924

[22] Filed: Dec. 12, 1986

[51] Int. Cl.[4] ..... E05B 17/04

[52] U.S. Cl. ..... 70/379 R; 70/380; 70/450; 70/461; 292/DIG. 52

[58] Field of Search ..... 70/380, 379 R, 134, 70/143, 129, 461, 447–451; 292/DIG. 52

[56] References Cited

U.S. PATENT DOCUMENTS

| | | | |
|---|---|---|---|
| 2,213,262 | 9/1940 | Segal | 70/379 R |
| 2,303,790 | 12/1942 | Chesler | 70/380 X |
| 2,618,955 | 11/1952 | Cerf, Jr. | 70/380 X |
| 2,642,735 | 6/1953 | Quigley | 70/380 X |
| 4,014,195 | 3/1977 | Grogan | 70/379 R |
| 4,068,510 | 1/1978 | Neary | 70/379 R |
| 4,109,496 | 8/1978 | Allemann et al. | 70/380 |
| 4,254,648 | 3/1981 | Dietrich | 70/380 |
| 4,272,974 | 6/1981 | Hennessy | 70/450 X |
| 4,301,667 | 11/1981 | Best et al. | 70/380 |
| 4,328,690 | 5/1982 | Oliver | 70/380 X |
| 4,369,642 | 1/1983 | Grell | 70/380 X |
| 4,466,264 | 8/1984 | Del Nero | 70/380 X |
| 4,470,278 | 9/1984 | Hale et al. | 70/380 X |
| 4,587,816 | 5/1986 | Garcia | 70/379 R X |
| 4,602,490 | 7/1986 | Glass et al. | 292/1 X |
| 4,635,453 | 1/1987 | Hart | 70/380 X |
| 4,656,849 | 4/1987 | Rotondi et al. | 70/461 X |
| 4,663,953 | 5/1987 | Fish et al. | 70/380 |
| 4,672,828 | 6/1987 | Theriault | 70/380 X |

FOREIGN PATENT DOCUMENTS

| | | | |
|---|---|---|---|
| 2063981 | 6/1981 | United Kingdom | 70/380 |

*Primary Examiner*—Robert L. Wolfe
*Assistant Examiner*—Suzanne L. Dino
*Attorney, Agent, or Firm*—Alan H. Levine

[57] ABSTRACT

A lock cylinder for use with either a deadbolt lock or a key-in-the-knob lock. The lock cylinder includes a hollow cylindrical body having a radially projecting, pin-containing chamber, extending along the length of the body, and a cylinder plug rotatably accommodated within the body. The plug holds a series of pins, which can be brought into alignment with the pins in the chamber, and the plug has a slot for accepting a key. Two tailpieces are provided, either of which may be alternatively secured to the cylinder plug in non-rotatable relationship to the plug. One of the tailpieces is cooperable with the mechanism for operating a deadbolt lock, and the other tailpiece is cooperable with the mechanism for operating a key-in-the-knob lock. One end of the cylinder plug is formed with a transverse slot and an annular slot, an extension at one end of each tailpiece fitting into the transverse slot, and a resilient snap ring fitting into the annular slot to prevent separation of the tailpiece from the plug.

3 Claims, 4 Drawing Sheets

MULTI-USE LOCK CYLINDER

This invention relates to locks, and more particularly to a lock cylinder having unique versatility.

Two types of locks in common use today are deadbolt lock and key-in-the-knob locks. A key-in-the-knob lock, as the name implies, involves a lock cylinder located within a doorknob. The lock cylinder is usually of the type including a hollow cylindrical body having a radially projecting chamber, extending along the length of the body for containing a series of pins. A cylinder plug is rotatably accommodated within the body, the plug also holding a series of pins which can be brought into alignment with the pins in the chamber when the plug and body are in one particular relative angular orientation. The plug has a slot for accepting a key, and if the proper key is inserted into the slot, the plug can be rotated with respect to the cylinder body, the latter being fixed with respect to the doorknob. A tailpiece, in the form of a long, narrow, flat bar projects axially from the end of the cylinder plug opposite the end into which the key is inserted, the tailpiece being fixed to and rotatable with the plug. Rotation of the cylinder plug by the key is transmitted, by the tailpiece, to the mechanism of the lock which causes the latch to retract and permit the door to be opened.

Deadbolt locks come in several varieties. For example, a mortise-type deadbolt lock is intended for use within a chamber located within a door, the chamber opening at the edge of the door opposite the hinged edge. A mortise lock employs a lock cylinder having a relatively large diameter cylindrical housing which is externally threaded so that it can be screwed into the lock cylinder hole in the mortise lock body. Because of its size and shape, a mortise lock cannot be used as the lock cylinder of a key-in-the-knob lock.

Another type of available dead-bolt lock is the so-called tubular deadbolt lock. This type of lock includes a lock bolt slidable within a guide tube, together with mechanism for shifting the bolt out of the tube, into a locking position, and retracting the bolt into the tube to permit opening of the door. The lock cylinder used with this type of deadbolt lock can be similar to the lock cylinder described above with respect to the key-in-the-knob lock except that a very different type of tailpiece must be employed. The tailpiece of a tubular deadbolt lock cylinder is relatively short, and may fit into a slot in, or engage a pin projecting from, the bolt-shifting mechanism. In either case, as the tailpiece is rotated, by rotation of the lock cylinder plug, the bolt is moved between its extended and retracted positions.

A problem presented by conventional tubular deadbolt locks involves the fact that the tailpiece is not fixed with respect to the cylinder plug. Instead, the tailpiece is permitted to rotate through an angle of less than 360° with respect to the cylinder plug, so as to provide a "lost motion" between the tailpiece and the plug. This lost motion is required to permit the key and cylinder plug to be rotated, after the bolt has reached its extended or retracted position, so that the pins carried by the plug can be aligned with the pins carried by the cylinder body, this being the only orientation in which the key can be removed from the cylinder plug. The difficulty presented by this lost motion arrangement is that the tailpiece must be assembled with the mechanism for operating the lock in one particular orientation. If assembly takes place with the tailpiece and mechanism in any other orientation, the lock will not work, i.e., the deadbolt cannot be moved to its fully extended or fully retracted position, or when the deadbolt is in one of those positions the key cannot be removed from the cylinder. Thus, if the installer does not precisely follow the instructions which accompany such a lock, the lock will not work after it has been completely mounted on the door, necessitating disassembly and remounting of the lock.

It would obviously be advantageous to a lock installer to have available a single type of lock cylinder which could be used both in deadbolt locks and key-in-the-knob locks, particularly if such a lock cylinder did not present the disadvantage of a lost motion connection between the cylinder plug and the tailpiece used when the lock cylinder is employed with a tubular deadbolt lock.

It is a general object of the present invention to provide a lock cylinder having just the advantages set forth above.

It is another object of the present invention to provide a lock cylinder which can alternatively be furnished with a tailpiece cooperable with the mechanism for operating a deadbolt lock or a tailpiece cooperable with the mechanism for operating a key-in-the-knob lock.

It is a further object of the invention to provide such a lock cylinder in which both types of tailpieces are fixed to the cylinder plug in a non-rotatable fashion, so that the problems presented by a lost motion connection between the cylinder pug and the tailpiece used with a tubular deadbolt lock are avoided.

Concomitantly, the invention relates to a method of assembling a single type of lock cylinder with either a deadbolt lock or a key-in-the-knob lock.

Additional objects and features of the present invention will be apparent from the following description, in which reference is made to the accompanying drawings.

Figure 1:
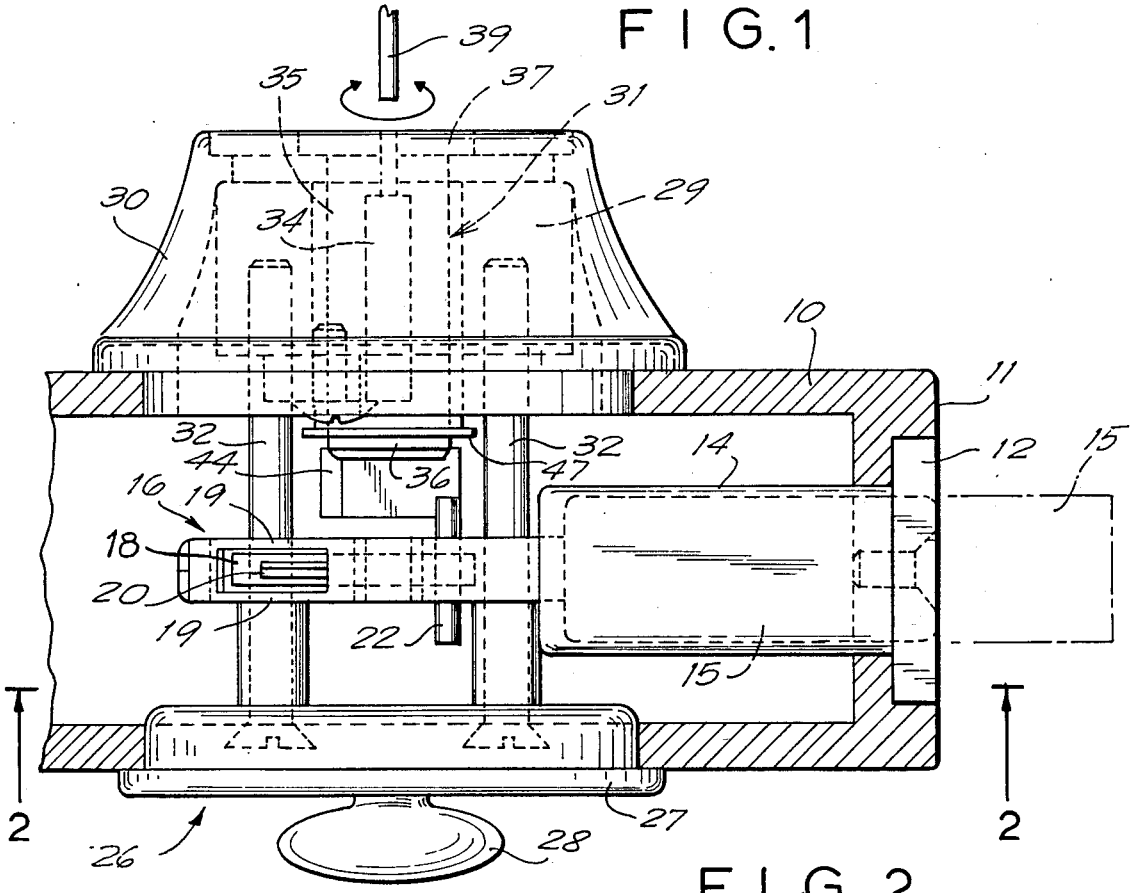
FIG. 1 is a horizontal cross-sectional view through a tubular deadbolt lock employing a lock cylinder according to the present invention.
Figure 2:
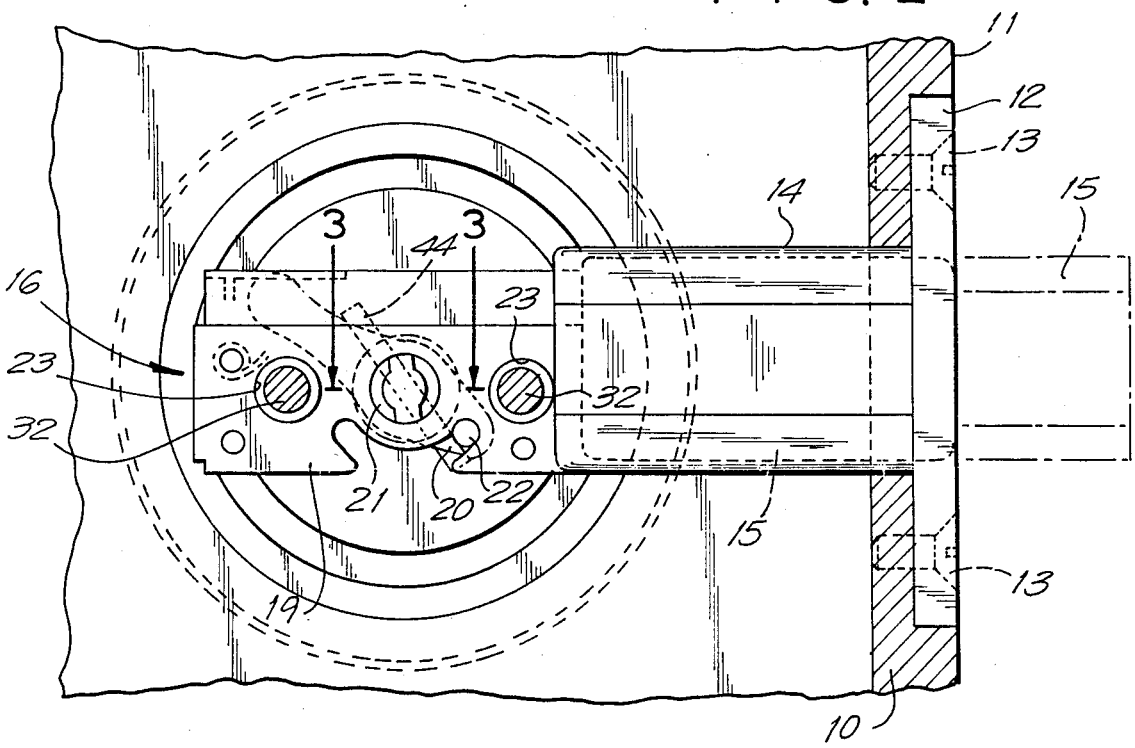
FIG. 2 is a vertical cross-sectional view taken along line 2—2 of FIG. 1.

The tubular deadbolt lock, illustrated in FIGS. 1 and 2, is completely conventional, except for the lock cylinder which follows the teachings of the present invention. The deadbolt lock is mounted within the hollowed-out portion of a door 10. The vertical edge 11 of the door, opposite the hinged edge of the door, is formed with an indentation for accommodating the face plate 12 of the lock, the face plate being secured to the door by screws 13. Extending into the door from face plate 12 is a tubular guide 14 within which a lock bolt 15 is axially slidable. Secured to the inner end of guide tube 14, and extending axially therefrom, is a mechanism 16 for operating bolt 15.

Figures 3, 4, 5:
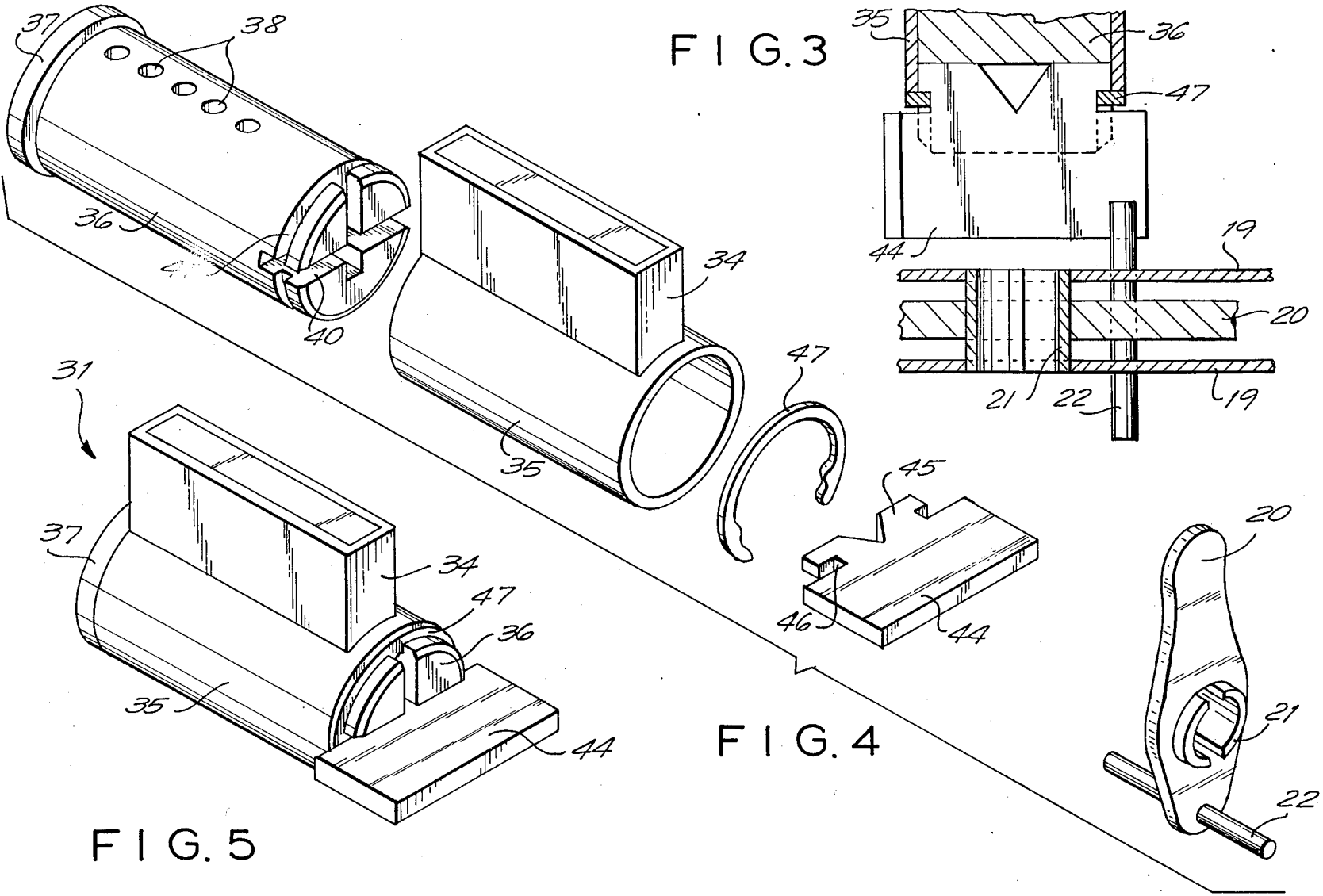
FIG. 3 is a fragmentary cross-sectional view, on an enlarged scale, taken along line 3—3 of FIG. 2.
FIG. 4 is an exploded perspective view of a lock cylinder according to the present invention, the figure also showing a part of the mechanism for operating the deadbolt lock.
FIG. 5 is a perspective view of the assembled lock cylinder.

Mechanism 16 includes a pair of spaced apart side walls 19 between which a lever 20 is pivotable on a short hollow tube 21, the latter extending between the two side walls 19 (see also FIG. 4). Lever 20 engages an extension 18 projecting axially from lock bolt 15, the extension being slidable with respect to walls 19, so that swinging movement of lever 20 about tube 21 causes longitudinal sliding movement of bolt 15 between its extended and retracted positions. At one side of tube 21, lever 20 carries a pin, or cam follower, 22. Each of the side walls 19 is formed with two holes 23 aligned with the corresponding holes in the other said wall.

Mounted an the inside of door 10 is a turnpiece assembly 26 including a trim plate 27 and a turnpiece 28. By means of a well known linkage (not shown), rotation of turnpiece 28 in two opposite directions produces sliding movement of bolt 15 into and out of guide tube 14. Mounted on the outside of door 10 is a lock cylinder housing 29 covered by a trim ring 30. Lock cylinder housing 29 supports, within it, the lock cylinder 31. The deadbolt lock illustrated in FIGS. 1 and 2 is of the type which can be "through bolted" for extra security. In other words, two mounting bolts 32 extend from trim plate 27, on the, interior of the door, through holes 23 in mechanism 16, and are threaded into holes in lock cylinder housing 29 on the exterior of the door.

The lock cylinder 31 of the present invention is best illustrated in FIGS. 4 and 5. The lock cylinder includes a hollow cylindrical body 35 having a radially projecting chamber 34 which extends along the length of body 35. As is conventional with this type of lock cylinder body, chamber 34 is formed with a series of vertical bores, say 5 bores, each bore having an axis radial with respect to body 35, and the series of bores being arranged along the length of chamber 34. Within each bore is a pin, above which is a spring continuously urging the pin radially inwardly toward the axis of body 35.

Rotatably accommodated within body 35 is a lock cylinder plug 36. At one of its ends, plug 36 is formed with an enlarged collar 37 which engages one end edge of body 35 and thereby limits the axial movement of plug 36 into body 35. Plug 36 is formed with a series, say 5, radial bores 38 which, when plug 36 is fully inserted into body 35, are aligned with the bores in chamber 36. As is usual, each bore 38 also slidably accommodates a pin. These pins extend to a longitudinal key slot within plug 66 and are engaged by a key 39 (FIG. 1) insertable into the key slot from the end of the plug having collar 37.

A its end opposite the end formed with collar 37, plug 36 is formed with a transverse slot 40. Close to that same end, plug 36 is also formed with an annular slot 41, the plane containing annular slot 41 intersecting the plane containing transverse slot 40.

A tailpiece, or cam, 44, especially adapted for cooperating with the mechanism of a deadbolt lock, is furnished for assembly with plug 36. Tailpiece 44 is a generally rectangular, short, wide, and flat plate. Along one of its long sides, tailpiece 44 presents a generally T-shaped, flat extension 45, adapted to fit into transverse slot 40 in plug 36. Extension 45 is reduced in width at region 46, this region registering with the plane containing annular slot 41 when extension 45 is fully inserted into slot 40. After plug 36 has been inserted into body 35, as shown in FIG. 5, extension 45 of tailpiece 44 is inserted into slot 40, so that reduced width region 46 registers with annular slot 41. Then, a resilient snap ring 47 is sprung into annular slot 41, engagement between the snap ring and extension 45 preventing separation of tailpiece 44 from plug 36.

Referring to FIGS. 1–3, it will be appreciated that when the correct key 39 is inserted into the key slot in the cylinder plug and rotated, cylinder plug 36 will also rotate, causing rotation of tailpiece 44. Pin 22, carried by lever 20, is located within the path of movement of tailpiece 44, and hence when the tailpiece engages pin 22, lever 20 will be pivoted about hollow tube 21. As a result, when tailpiece 44 is rotated in one direction, bolt 15 will be shifted out of guide tube 14 into a locking position. When tailpiece 44 is rotated in the opposite direction, bolt 15 will be slid into guide tube 15 so as to permit opening of the door.

It should be noted that tailpiece 44 has been secured to cylinder plug 36 so that the tailpiece rotates with the plug but is non-rotatable with respect to the plug. Consequently, there is no special orientation which tailpiece 44 must assume in order to be assembled with the mechanism 16 for operating the lock. No matter which orientation tailpiece 44 assumes at the time of assembly, the lock will operate properly, i.e., the deadbolt can be fully extended and retracted, and in either of these positions the key can be removed from the cylinder.

The lock cylinder described above with respect to FIGS. 1–5, for use with a deadbolt lock, can optionally be used with a key-in-the-knob lock, as showing FIGS. 6–9, the only change involved being the use of a different tailpiece secured to cylinder plug 36. Therefore, those parts in FIGS. 6–9 which are identical to the parts of FIGS. 1–5 bear the same reference numerals.

Figure 6:
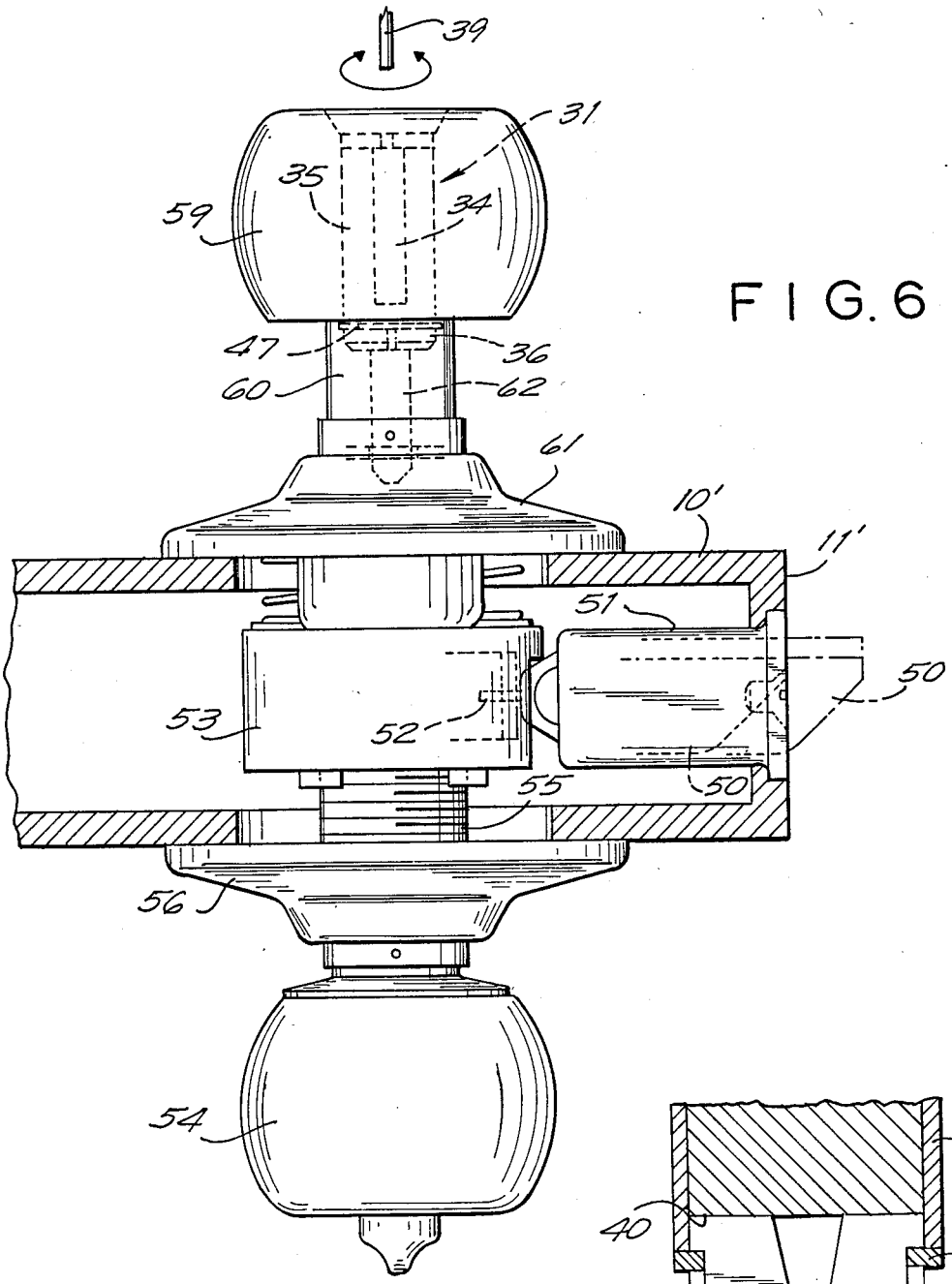
FIG. 6 is a horizontal cross-sectional view of a key-in-the-knob lock employing a lock cylinder according to the present invention.
Figure 7:
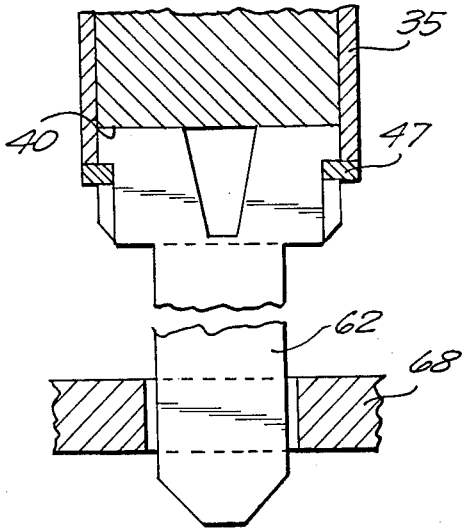
FIG. 7 is an enlarged view of a portion of FIG. 6.

The key-in-the-knob lock illustrated in FIG. 6 is completely conventional, except for the lock cylinder 31 which is employed. The lock includes a latch 50 slidable longitudinally within a guide tube 51, between an extended position, in which it latches the door closed, and a retracted position in which it permits the door to be opened. A spring (not shown) constantly urges the latch to its extended position. Extending inwardly from the inner end of latch 50 is a T-shaped fitting 52 which is engageable by the mechanism 53 for operating the latch.

An inner doorknob 54 is mounted on a tube 55 which passes through an inside rose 56 secured to the inner surface of the door 10'. When doorknob 54 is rotated, tube 55 operates mechanism 53 so as to retract latch 50 into guide tube 51.

An outer doorknob 59 is mounted on a tube 60 which passes through an outside rose 61 into operative relationship with mechanism 53. Outside rose 61 is secured against the outer surface of door 10'. Outer doorknob 59 is formed with a central bore for accommodating the lock cylinder 31.

Figures 8, 9:
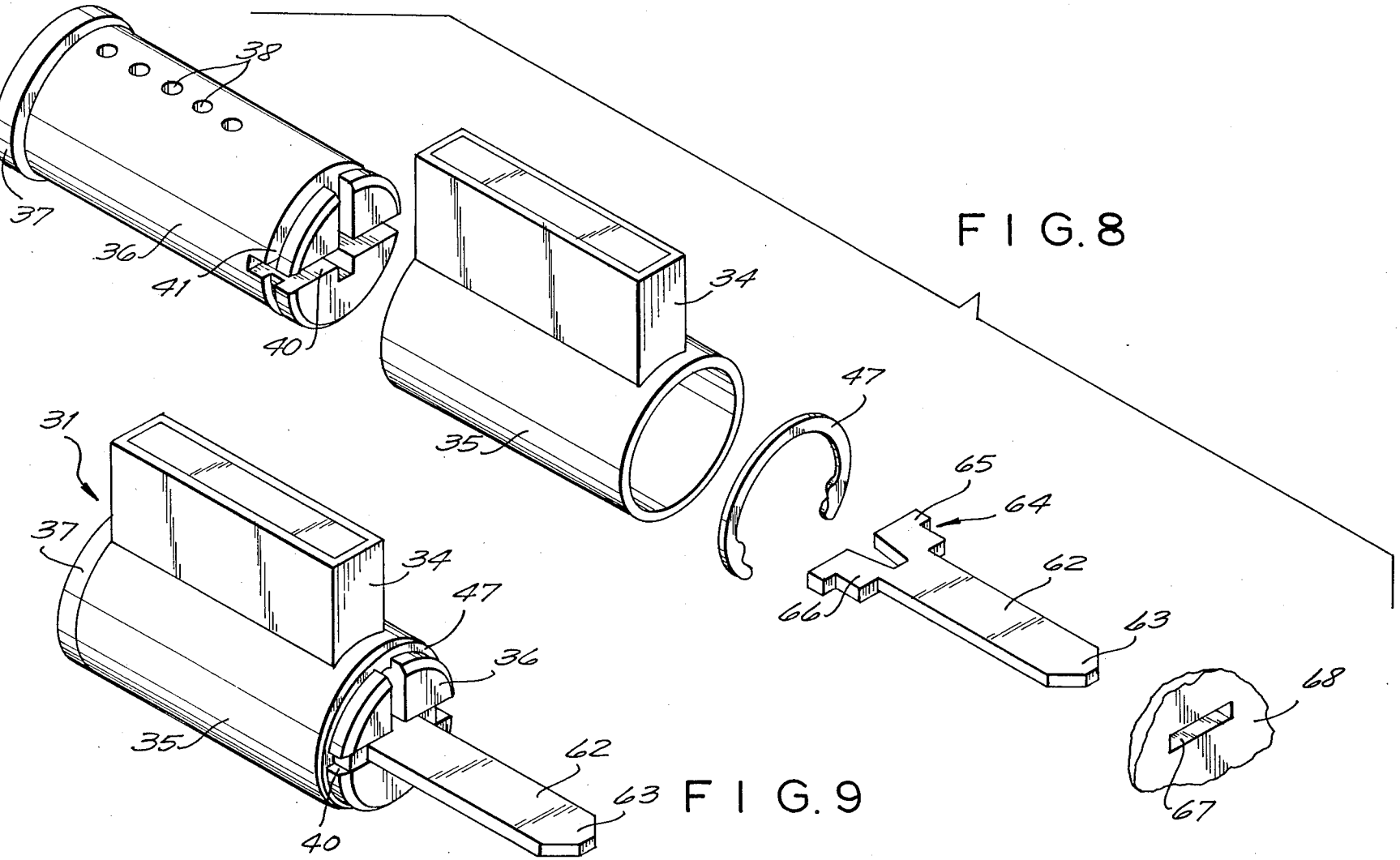
FIG. 8 is an exploded perspective view of a lock cylinder according to the present invention, the view also showing a part of the mechanism for operating the key-in-the-knob lock.
FIG. 9 is a perspective view of the assembled lock cylinder.

As best shown in FIGS. 8 and 9, lock cylinder 31 used with the key-in-the-knob lock of FIG. 6 is identical to lock cylinder 31 of FIGS. 4 and 5, except for the tailpiece employed. The tailpiece 62 of FIGS. 8 and 9 is a long, narrow, and flat bar tapered at one of its ends 63. At its opposite end, tailpiece 62 presents a flat extension 64 having a stepped configuration. The endmost part 65 of extension 64 is its widest part, so that the part 66 of extension 64 is reduced in width as compared to the free end 65.

After cylinder plug 36 has been fully inserted into cylinder body 35, as shown in FIG. 9, tailpiece 62 can be assembled with plug 36 by slipping extension 64 into slot 40, so that part 66 of the extension registers with annular slot 41. Then, resilient snap ring 47 is snapped into slot 41, snap ring 47 engaging free end 65 of tailpiece 62 so as to prevent separation of the tailpiece from plug 36.

In use, tailpiece 62 fits into a narrow slot 67 (FIG. 8) formed in a rotatable part 68 coupled to mechanism 53. Consequently, when a proper key 39 is slipped into the key slot in cylinder plug 36 and rotated, plug 36 rotates as a result of which tailpiece 62 rotates as does part 68. This rotation causes mechanism 53 to retract latch 50 into guide tube 51 so that the door can be opened.

It will be seen from the above description that the same lock cylinder can be used in cooperation with either a deadbolt lock or a key-in-the-knob lock, it being necessary only to use the proper tailpiece 44 or 62. Each tailpiece is readily assembled with the remainder of the lock cylinder by means of snap ring 47. In fact, it is even possible to switch the same lock cylinder from a deadbolt lock to a key-in-the-knob lock, or vice versa, simply by removing snap ring 47, exchanging tailpieces, and replacing snap ring 47. Of importance is the fact that when tailpiece 44 is employed, so that the lock cylinder can be used with a deadbolt lock, the tailpiece is non-rotatable with respect to cylinder plug 36, so that no particular orientation of the tailpiece is required for assembly with the remainder of the lock to cause the lock to operate properly.

It may be mentioned that in the embodiment of FIG. 1, turnpiece 28 could be replaced with a lock cylinder similar to lock cylinder 31, which would operate in exactly the same way as lock cylinder 31, so that a key would be required at both sides of the door to operate the deadbolt. Also, as used herein, the term key-in-the-knob lock refers to the most common kind of such lock, known as a key-in-the-knob cylindrical lock, a tailpiece typically being used with such a lock, but not necessarily with other types of key-in-the-knob locks The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

I claim:

1. A deadbolt lock comprising:

a bolt slidable between extended and retracted positions, a mechanism for operating the bolt including a stationary portion and a rotatable member carried by the stationary portion, the bolt being slidable in response to rotation of the rotatable member, a pair of holes in the stationary portion, a lock cylinder housing having a pair of holes, a pair of mounting bolts passing through the holes in the stationary portion and into the holes in the lock cylinder housing, a cylinder plug carried by and rotatable with respect to the housing, the axis of rotation of the cylinder plug being colinear with the axis of rotation of the rotatable member, a tailpiece carried by the cylinder plug in non-rotatable relationship thereto, a cam follower carried by the rotatable member at a point spaced from the axis of rotation of the latter, the cam follower being located in the path of movement of the tailpiece, and the colinear axes of rotation of the cylinder plug and the rotatable member being located in the same plane which contains the mounting bolts.

2. A deadbolt lock as defined in claim 1 including a hollow cylindrical lock cylinder body, the cylinder plug being rotatably accommodated within the cylinder body, and the cylinder body being accommodated within the lock cylinder housing in non-rotatable relation thereto, the cylinder body and plug being of the type useable within a key-in-the-knob lock.

3. A deadbolt lock as defined in claim 2 wherein the tailpiece is a part independant of the cylinder plug, and including means for removably securing the tailpiece to the cylinder plug, whereby different tailpieces for use in a deadbolt lock or in a key-in-the-knob lock may be mounted on the cylinder plug.

* * * * *